United States Patent [19]

Ono et al.

[11] Patent Number: 4,945,883

[45] Date of Patent: Aug. 7, 1990

[54] CONTROL DEVICE FOR INTERNAL COMBUSTION ENGINE

[75] Inventors: Kenichi Ono, Obu; Masumi Kinugawa, Okazaki; Masakazu Ninomiya, Kariya; Atsushi Suzuki, Obu, all of Japan

[73] Assignee: Nippondenso Co., Ltd., Kariya, Japan

[21] Appl. No.: 318,185

[22] Filed: Mar. 2, 1989

[30] Foreign Application Priority Data

Mar. 3, 1988 [JP] Japan ..... 63-50120

[51] Int. Cl.[5] ..... F02M 51/00

[52] U.S. Cl. ..... 123/494; 123/480

[58] Field of Search ..... 123/494, 488, 486, 478; 364/431.05, 431.06, 510

[56] References Cited

U.S. PATENT DOCUMENTS

| | | | |
|---|---|---|---|
| 4,264,961 | 4/1981 | Nishimura et al. | 364/510 |
| 4,593,667 | 6/1986 | Sasaki et al. | 123/488 |
| 4,616,621 | 10/1986 | Kuroiwa et al. | 123/488 |
| 4,664,085 | 5/1987 | Katayoka | 123/478 |
| 4,741,313 | 5/1988 | Shimonura | 123/494 |
| 4,753,206 | 6/1988 | Inoue et al. | 123/478 |
| 4,773,375 | 9/1988 | Okino et al. | 123/494 |
| 4,785,784 | 11/1988 | Nanyoshi et al. | 123/478 |
| 4,792,905 | 12/1988 | Sekozawa et al. | 123/480 |

*Primary Examiner*—Raymond A. Nelli

*Attorney, Agent, or Firm*—Cushman, Darby & Cushman

[57] ABSTRACT

An internal combustion engine control device is constructed to estimate an engine air intake quantity based on an engine speed when the engine is running in an intake air pulsation generating range to control the engine in accordance with the air intake quantity thus estimated. The estimated air intake quantity is corrected by a correction value which is related to the density of the intake air.

19 Claims, 8 Drawing Sheets

CONTROL DEVICE FOR INTERNAL COMBUSTION ENGINE

BACKGROUND OF THE INVENTION

1. Field of the Invention

This invention relates to a control device for an internal combustion engine for a vehicle, which is designed to control the internal combustion engine in accordance with air intake quantity which is detected by an air intake quantity detecting means provided in the suction system of the internal combustion engine.

2. Description of the Prior Art

In a conventional control system for an internal combustion engine, the amount of air sucked into the engine is measured by means of an air intake quantity sensor (heat-wire type, Karman's vortex type or a vane type) arranged in the suction pipe. The engine operation is controlled by determining the amount of fuel to be supplied to the engine, the ignition timing, etc., in accordance with the air intake quantity thus measured.

The problem with this type of control device is that, when the throttle valve is almost fully open, the degree of intake air pulsation in the suction pipe is intensified, resulting in an increase in error in the measurement of the intake air amount by the intake air amount sensor, so that sufficient accuracy in measurement cannot be assured. When the fuel amount is determined in accordance with an intake air amount signal containing many errors, the air-fuel ratio of the air-fuel mixture will become either too rich or too lean.

In view of this, a conventional control device is so designed that, whenever the opening of the throttle valve is detected to exceed a predetermined degree, it ceases to utilize the intake air amount signal. Instead, it then estimates the intake air amount from the engine speed, executing the above control in accordance with the air intake quantity thus estimated (see Japanese Unexamined Patent Publication No. 55-142942).

However, the prior art device disclosed in the above-mentioned publication is not free from any problem. As described above, this prior art device is so designed that, when that is engine operated under a condition where it is subjected to generation of intake air pulsation, for example, when the throttle valve is almost fully open, the air intake quantity is estimated exclusively from the engine speed, or more specifically, the basic injection timing is read out from a table in which data is previously stored. If a vehicle equipped with this control device is used even in a place where the air density is relatively low and, consequently, the weight of air contributing to combustion is relatively small, which is the case, for example, on a high altitude, a predetermined basic injection timing which is the same as that used at lower altitudes will be set, and the same amount of fuel as is appropriate for low altitudes will be supplied to the engine, which will result in an excessively rich air-fuel ratio, reduced output and malfunction of the engine.

SUMMARY OF THE INVENTION

It is, accordingly, an object of this invention to provide an internal combustion engine control device of the type in which, when the engine is running in a condition where intake air pulsation takes place, the air intake quantity is estimated from the engine speed and the engine is controlled in accordance with the air intake quantity thus estimated, said control device being capable of precisely estimating the air intake quantity without being affected by the environment to thereby alway control the engine in a satisfactory manner.

The present invention provides a control device for an internal combustion engine, comprising, as shown in FIG. 11:

air intake quantity detecting means for detecting a quantity of air sucked into the internal combustion engine;

engine speed detecting means for detecting a rotational speed of the internal combustion engine;

judging means for judging whether or not the engine is running in an intake air pulsation generating range based on operational parameters of the engine;

air intake quantity estimating means for estimating a quantity of air sucked into the internal combustion engine based on the engine speed detected by said engine speed detecting means;

correction value calculating means for calculating a correction value related to the density of the air sucked into the internal combustion engine;

correction means for correcting, by the correction value obtained by means of said correction value calculating means, the air intake quantity estimated by means of said air intake quantity estimating means; and control means adapted to control the engine in accordance with the estimated air intake quantity as corrected by said correction means when the engine is judged to be running in the intake air pulsation generating range, and in accordance with the air intake quantity detected by said air intake quantity detecting means when the engine is judged to be running outside the intake air pulsation generating range.

With the above construction, an air intake quantity estimated based on the engine speed is corrected by a correction value related to the density of the air sucked into the engine. The control means controls the engine by using the estimated air intake quantity thus corrected when the engine is running in an intake air pulsation generating range. Thus, any reduction in the engine output and malfunctioning of the engine can be avoided even if a vehicle moves from a lower to a higher altitude.

The correction value related to the density of the intake air may, for example, be one which can be obtained by detection of the atmospheric pressure.

Furthermore, the device in accordance with this invention described above may include air-fuel ratio detecting means, so the control means of the present invention compars the air-fuel ratio thus detected with a predetermined air-fuel ratio to adjust the amount of fuel to be supplied to the engine such that the two air-fuel ratios become equal to each other. With this construction, any decrease in the density of air contributing to the combustion causes an air-fuel ratio correction value, which is obtained through comparison of the detected air-fuel ratio and the predetermined air-fuel ratio, to change accordingly, so that a correction value for correcting the estimated air intake quantity can be obtained by using this air-fuel ratio correction value.

DETAILED DESCRIPTION OF PREFERRED EMBODIMENTS

Figure 1:
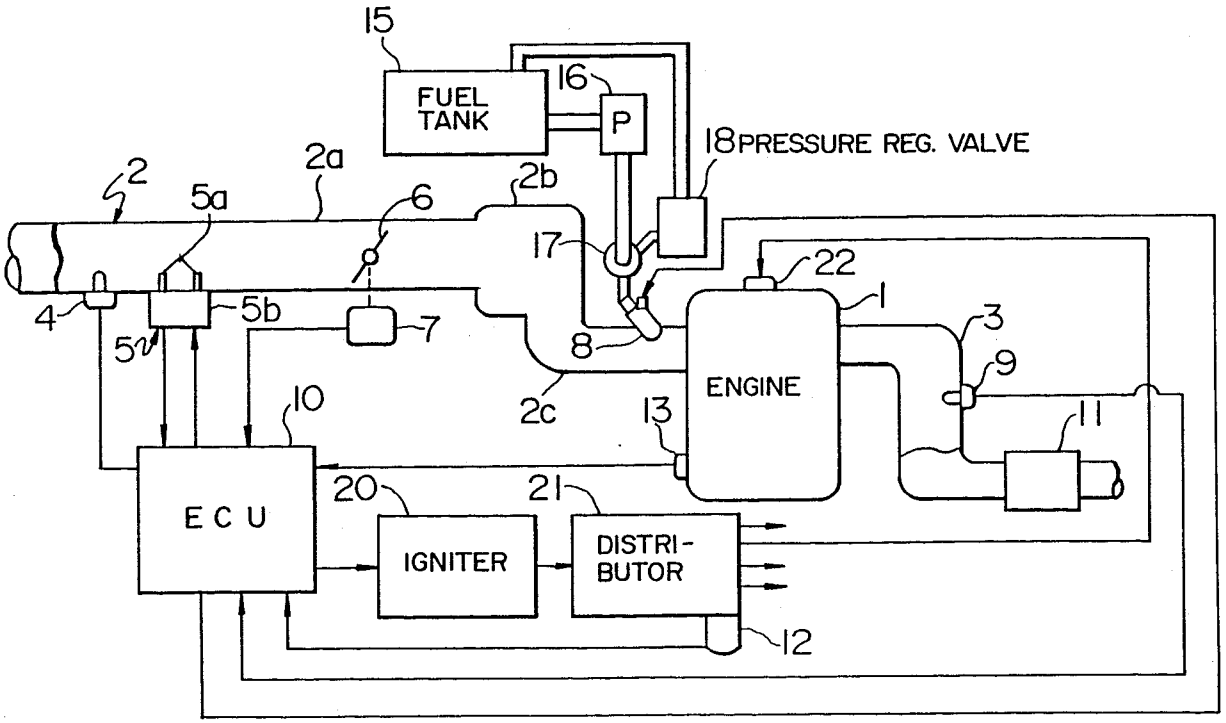
FIG. 1 is a diagram showing the arrangement of an internal combustion engine to which an embodiment of this invention is applied and peripheral equipment thereof.

An embodiment of this invention will be described with reference to the attached drawings FIG. 1 schematically shows an arrangement of an internal combustion engine to which an embodiment of this invention is applied and peripheral equipment thereof. The internal combustion engine 1 shown includes a 4-cylinder petrol engine 1 (hereinafter referred to simply as "engine") of spark ignition type which is mounted on a vehicle and to which a suction pipe 2 and an exhaust pipe are connected.

Connected to the upstream end of the suction pipe 2 is an air cleaner (not shown). A collecting pipe 2*a* of the suction pipe 2 is equipped, as viewed from the upstream end, with an intake air temperature sensor 4 for detecting the intake air temperature, an air intake quantity sensor 5 for detecting the air intake quantity, a throttle valve 6 linked with an acceleration pedal operated by the driver and adapted to control the quantity of air sucked into the engine 1, and a throttle sensor 7 for detecting the opening degree of the throttle valve 6.

The collecting pipe 2*a* of the suction pipe 2 is connected to a surge tank 2*b*. Branch pipes 2*c* (only one of which is shown) are provided between the surge tank 2*b* and the respective cylinders of the engine 1. Each of these branch pipes 2*c* includes an electromagnetic fuel injection valve 8.

Provided in the exhaust pipe 3 is an air-fuel ratio sensor 9 adapted to control the air-fuel ratio in accordance with the oxygen content in the exhaust gas such that it generates a signal of 1 V when the air-fuel ratio of the air-fuel mixture supplied to the engine 1 is richer than the stoichiometrical air-fuel ratio and a signal of 0.1 V when leaner than it. A catalytic converter 11 is provided on the downstream side of the air-fuel ratio sensor 9.

The detection signals from the above-mentioned sensors are input to an electronic control unit (ECU) 10 composed of a microcomputer, etc. Apart from these signals, also input to the ECU 10 are detection signals from a speed sensor 12 adapted to output a pulse signal for each of a number of predetermined angles of rotation of the engine 1, and signals from a water temperature sensor 13 provided on the engine 1 and adapted to detect the temperature of the engine cooling water.

The above-mentioned air intake quantity sensor 5 is an air flow meter composed of a temperature sensing element 5*a* arranged in the collecting pipe 2*a* and a circuit section 5*b* adapted to supply electricity to this element 5*a* and output a signal to the ECU 10 in accordance with the condition of the electricity supply, the supply of electricity to the temperature sensing element 5*a* being controlled in accordance with the instructions from the ECU 10. The above-mentioned temperature sensing element 5*a* is made of a resistance material such as platinum which exhibits a temperature resistance characteristic that it generates heat when supplied with electricity, and the resistance value changes with the temperature.

The fuel supply system for supplying fuel to the above-mentioned fuel injection valves 8 is composed of a fuel tank 15, a fuel pump 16 for pumping the fuel from the tank 15 to the fuel injection valves 8, a delivery pipe 17 for distributing the fuel from the pump 16 to the fuel injection valves 8, a pressure regulating valve 18 for adjusting the pressure of the fuel supplied to the fuel injection valves 8 to a predetermined value, and piping for connecting these members each other.

The ECU 10 to which the detection signals from the above-mentioned sensors are input outputs drive signals in accordance with those detection signals to an igniter 20 and the fuel injection valves 8 as well as to the above-mentioned air intake quantity sensor 5. The igniter 20 is connected to a distributor 21 for distributing the high voltage generated in the igniter 20 to the ignition plugs 22 of predetermined cylinders. The speed sensor 12 is provided on the distributor 21.

Figure 2:
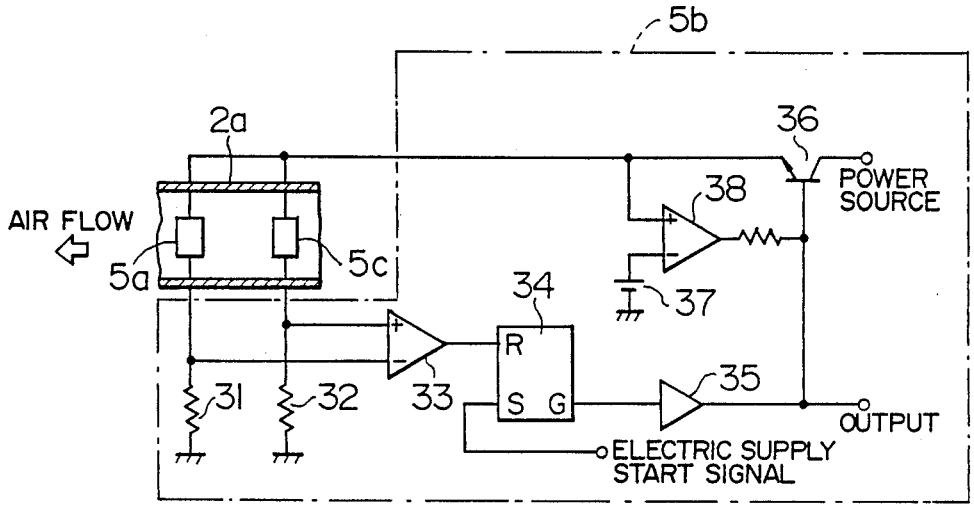
FIG. 2 is a circuit diagram showing the construction of an air intake quantity sensor in FIG. 1.

FIG. 2 shows the circuit structure of the air intake quantity sensor 5 used in the manner described above. Provided within the collecting pipe 2*a* is an auxiliary temperature sensing element 5*c*, in addition to the above-mentioned temperature sensing element 5*a*. This auxiliary temperature sensing element 5*c*, which has a construction similar to that of the temperature sensing element 5*a*, serves to detect the temperature of the air in the collecting pipe 2*a*. The temperature sensing elements 5*a* and 5*c* form, together with stationary resistors 31 and 32 in the circuit section 5*b*, a bridge circuit, the output terminals of which are connected to a comparator 33 adapted to generate an output signal when the temperature of the temperature sensing element 5*a* has risen to a predetermined value which is specified with respect to the temperature of the air in the collecting pipe 2*a*. The output signal from the comparator 33 serves to reset a flip-flop circuit 34 which is set by means of an electricity-supply-start signal from the above-mentioned ECU 10. This electricity-supply-start signal consists of, for example, a pulse signal generated in each time period which is half the length of one ignition cycle (i.e. 90° since the engine to which this embodiment is applied is a 4-cylinder, 4-cycle one).

The setting time output signal of this flip-flop circuit 34 is extracted through a buffer amplifier 35 as an output signal the pulse time width of which can be set. It further controls the base of a transistor 36, applying a predetermined voltage to the bridge circuit containing the temperature sensing element 5*a* during the setting period of the flip-flop circuit 34. The predetermined voltage applied to the above-mentioned bridge circuit is adjusted to a constant value by a reference power source 37 and a differential amplifier 38.

Figure 3:
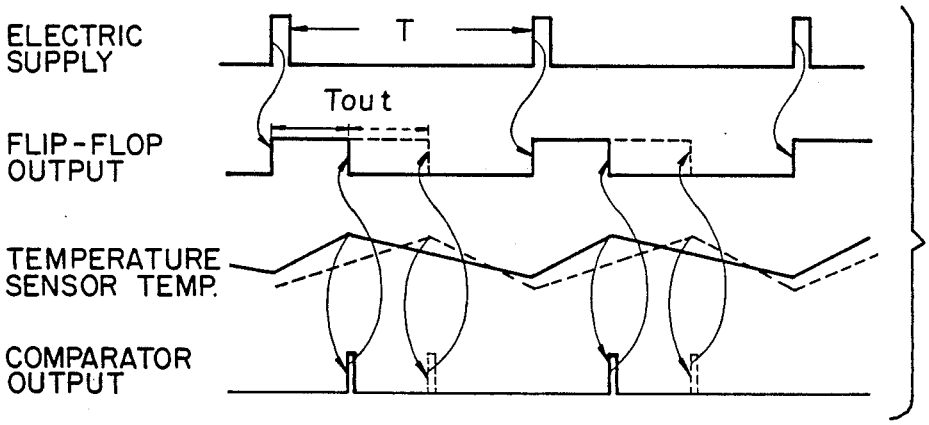
FIG. 3 is a time chart illustrating the operation of the above air intake quantity sensor.

Suppose the electricity-supply-start signal is generated in the manner shown in the electric supply part of FIG. 3, the flip-flop circuit 34 is set in response to this signal, the output signal from this circuit 34 rising in the manner shown in the flip flop output of FIG. 3. This signal turns on the transistor 36, which causes electricity to be supplied to the temperature sensing element 5a, the temperature of the element 5a rising in the manner shown in the temperature sensor line of FIG. 3.

When the temperature of the temperature sensing element 5a thus rises, and reaches a value which is predetermined for the air temperature detected by the auxiliary temperature sensing element 5c, the output signal from the comparator 33 rises in the manner shown in the comparator output of FIG. 3, thereby resetting the flip-flop circuit 34. In other words, when a certain voltage is applied to the temperature sensing element 5a, the temperature of the temperature sensing element 5a rises in correspondence with the air flow through the collecting pipe 2a. Consequently, the length of the time period $T_{out}$ during which the flip-flop circuit 34 is set corresponds to the above-mentioned air flow.

Figure 4A:
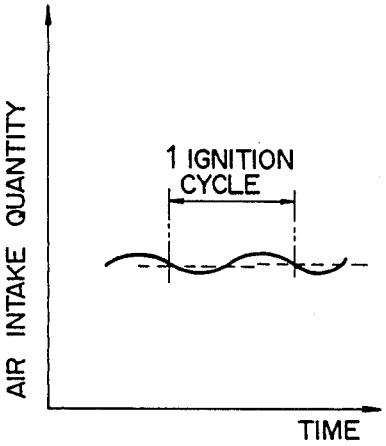
FIGS. 4A, 4B and 4C are waveform charts illustrating changes with time of the air intake quantity under a low, a middle and a high load.
Figure 4B:
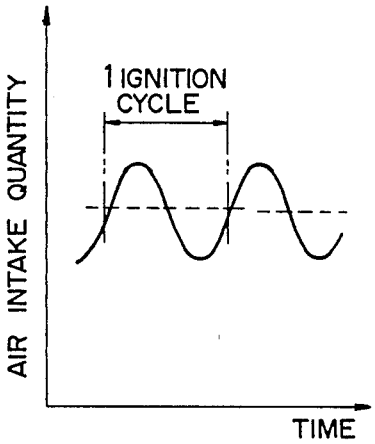
Figure 4C:
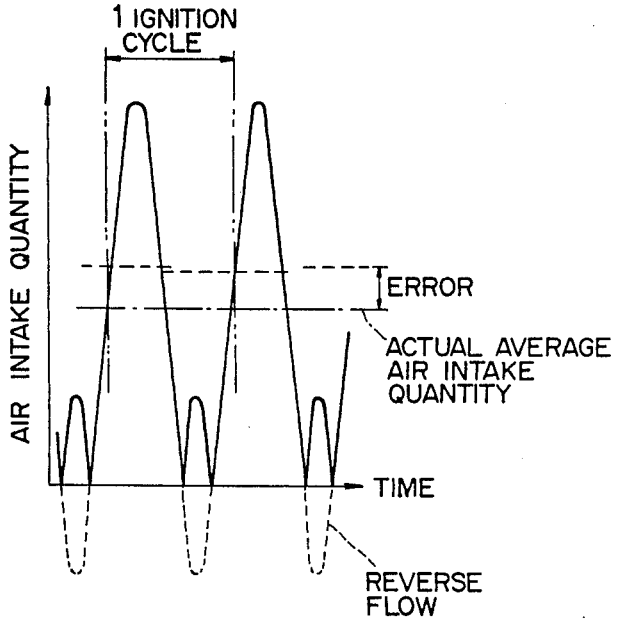

FIGS. 4A and 4B illustrate the manner in which the air flows through the collecting pipe 2a under a light load and a middle load, respectively. In each of these drawings, the solid line indicates the change of the air flow condition, and the dashed line indicates the way in which the detected air flow is displayed. Under a heavy load condition, however, reverse flow components due to the intake air pulsation of the engine 1 are generated, as shown in FIG. 4C, and components are detected by the temperature sensing element 5a in the same condition as the normal air flow components. Accordingly, the above-mentioned reverse flow components are detected as measurement errors, so that an error is present between the detected and the actual average air flows.

In this embodiment, therefore, the air intake quantity is not detected on the basis of the signal from the air intake quantity sensor when the engine is running within the intake air pulsation generating range in which the air intake quantity signal contains errors. Instead, the air intake quantity is estimated on the basis of the engine speed to control the engine in accordance with the value thus estimated.

Figure 5:
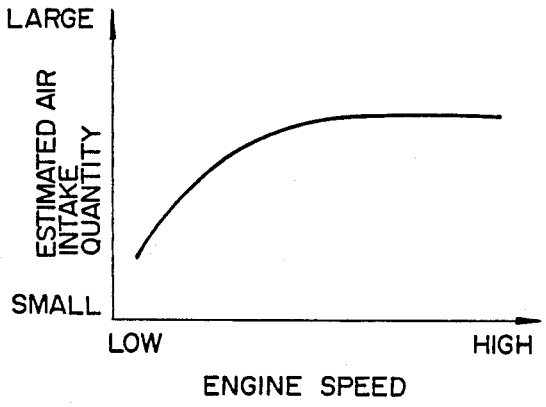
FIG. 5 is a characteristic chart illustrating the relationship between the estimated air intake quantity and the engine speed.

Since the above-mentioned error components are only generated when the throttle valve 6 is almost fully open, a judgment as to whether or not the engine 1 is running within a range in which the errors mentioned above are generated (intake air pulsation generating range) is made by seeing, for example, whether the throttle valve 6 is open beyond a predetermined degree. If the throttle valve 6 is open beyond a predetermined degree, the engine 1 is considered to be running within the intake air pulsation generating range. In this case, the signal from the air intake quantity sensor 5 is not utilized but, instead, the air intake quantity corresponding to the engine speed is read out from a map which is stored in a readout memory ROM of the ECU 10 and set to have the characteristic shown in FIG. 5, to control the engine. In this connection, the actual air intake quantity of the engine 1 in the intake air pulsation generating range under a normal condition (760 mmHg and 20° C.), for example, may be stored in the above-mentioned map.

If the engine 1 is detected to be running in the pulsation generating area and the map value is adopted, no problem arises as long as the engine is running under the normal condition in accordance with which the map value was determined, since the map value is equal to the actual air intake quantity of the engine 1. In a condition, however, in which the density of the intake air is varied, which is the case on a high altitude or in a cold season, the map value differs from the actual air intake quantity (weight) of the engine 1. Thus, if the fuel amount is determined on the basis of this map value, the air-fuel ratio will become excessively rich or lean, affecting the driving performance in an undesirable manner. In view of this, a correction value corresponding to the intake air density is determined in this embodiment, thereby making it possible to estimate the air intake quantity with accuracy.

Figure 6:
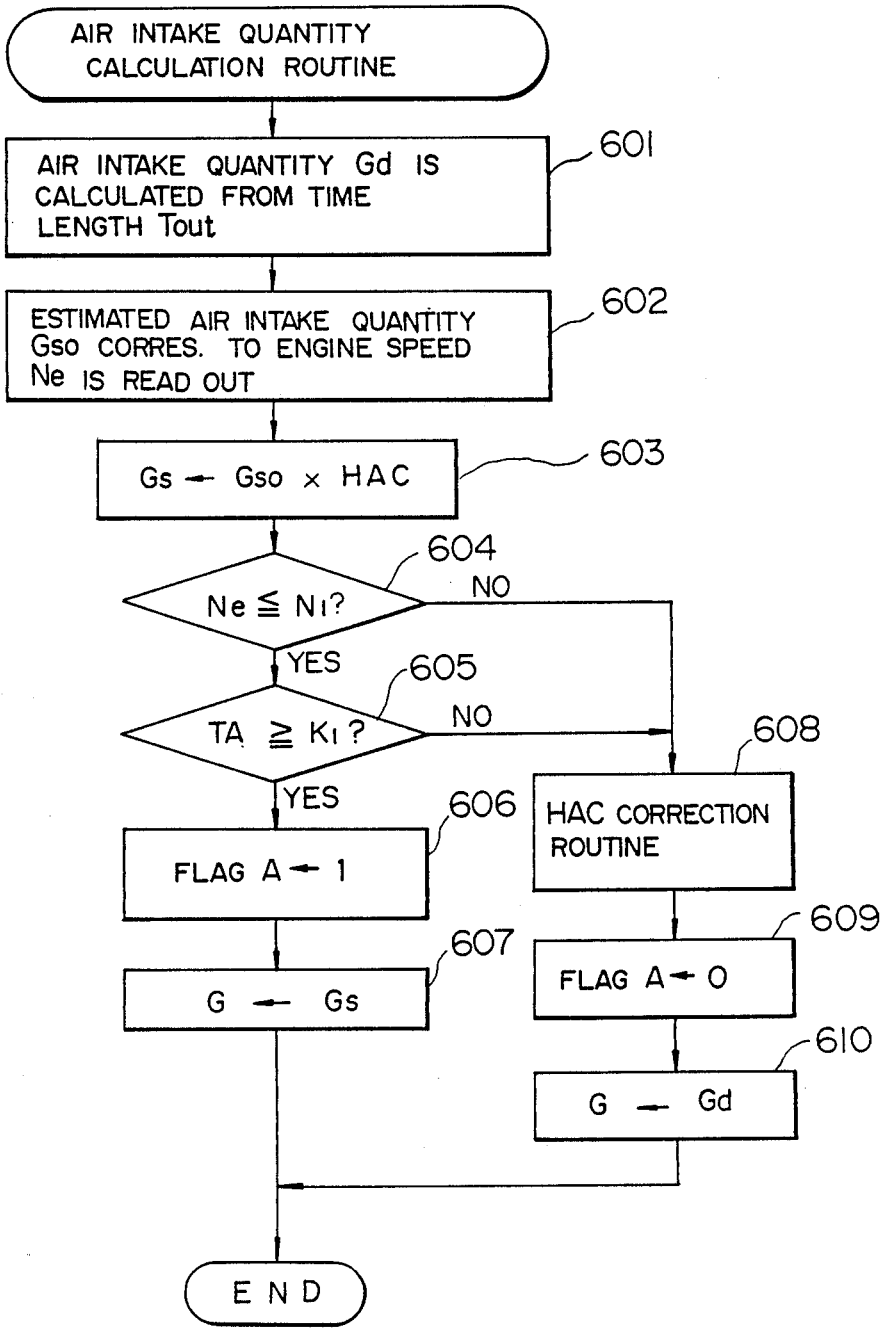
FIGS. 6, 7 and 9 are flowcharts illustrating the processing executed by an ECU.

The flowchart of FIG. 6 illustrates the process of calculating the air intake quantity executed in the central processing unit in the ECU 10. According to this routine, the detected air intake quantity Gd is calculated in Step 601 on the basis of the time length $T_{out}$ of the output signal from the air intake quantity sensor 5. More specifically, the detected air intake quantity Gd corresponding to one ignition cycle is calculated from the sum of the respective time lengths $T_{out}(i)$ and $T_{out}(i+1)$ of two output signals obtained during one ignition cycle. Next, in Step 602, the estimated air intake quantity Gso in the normal condition corresponding to the engine speed Ne which can be obtained from the signal from the speed sensor 12 is read out from the map which is set in the manner described above. In Step 603, the estimated air intake quantity read out in Step 602 is corrected by being multiplied by the correction coefficient HAC which is stored in an RAM backed up by the power source, to thereby determine the new estimated air intake quantity Gs. Next, in Step 604, whether or not the engine speed Ne is at a predetermined value $N_1$ or less. If Ne is found to be at $N_1$ or less, the procedure of Step 605 is executed. If Ne is higher than $N_1$, the process proceeds to Step 608. The predetermined value $N_1$ is set to be the maximum of the engine speed value at which the above-mentioned error can be caused on the detected air intake quantity Gd because of the intake air pulsation. In other words, if, in Step 604, the engine speed Ne is found to be a value within the intake pulsation generating range, the procedure of Step 605 is executed. If not, the process proceeds to the Step 608. Subsequently, in Step 605, a judgment is made as to whether or not the throttle valve opening degree TA is beyond a predetermined value $K_1$. If TA is greater than $K_1$, the process proceeds to Step 606, and if not, to Step 608. The predetermined value $K_1$ is set to be the minimum of the throttle opening degree at which the above-mentioned error begins to be caused on the detected air intake quantity Gd because of the intake air pulsation. If this predetermined value of the throttle valve opening degree changes depending upon the engine speed Ne, the relationship between the predetermined value $K_1$ and the engine speed Ne may be stored in the map beforehand so that the value may be read out from the map in accordance with the engine speed Ne. Thus, Steps 604 and 605 are provided in order to judge whether or not the engine 1 is running within the pulsation generating range in which errors are contained in the detected air intake quantity Gd because of the intake air pulsation.

If the procedure of Step 606 is to be executed, a flag A indicating that the engine 1 is running within the intake air pulsation generating range is set up. In Step 607, the estimated air intake quantity Gs is stored at a predetermined address G in the read/write memory RAM in which the air intake quantity used for controlling the engine is stored, to finish this routine. On the other hand, when the process proceeds from Step 604 or 605 to Step 608, i.e., when the engine is judged to be running within the range in which no pulsation is generated or in which no such pulsation as will cause errors to be contained in the detected air intake quantity Gd is generated, the routine of correcting the correction coefficient coefficient hac which is described below is executed in Step 608. The flag A is cleared in Step 609. In Step 610, the detected air intake quantity Gd is stored at the address G in the RAM for storing the data on the air intake quantity for controlling the engine, to finish this routine. Accordingly, thanks to the above-described calculating process, a proper air intake quantity is always stored at the address g in the RAM.

Figure 7:
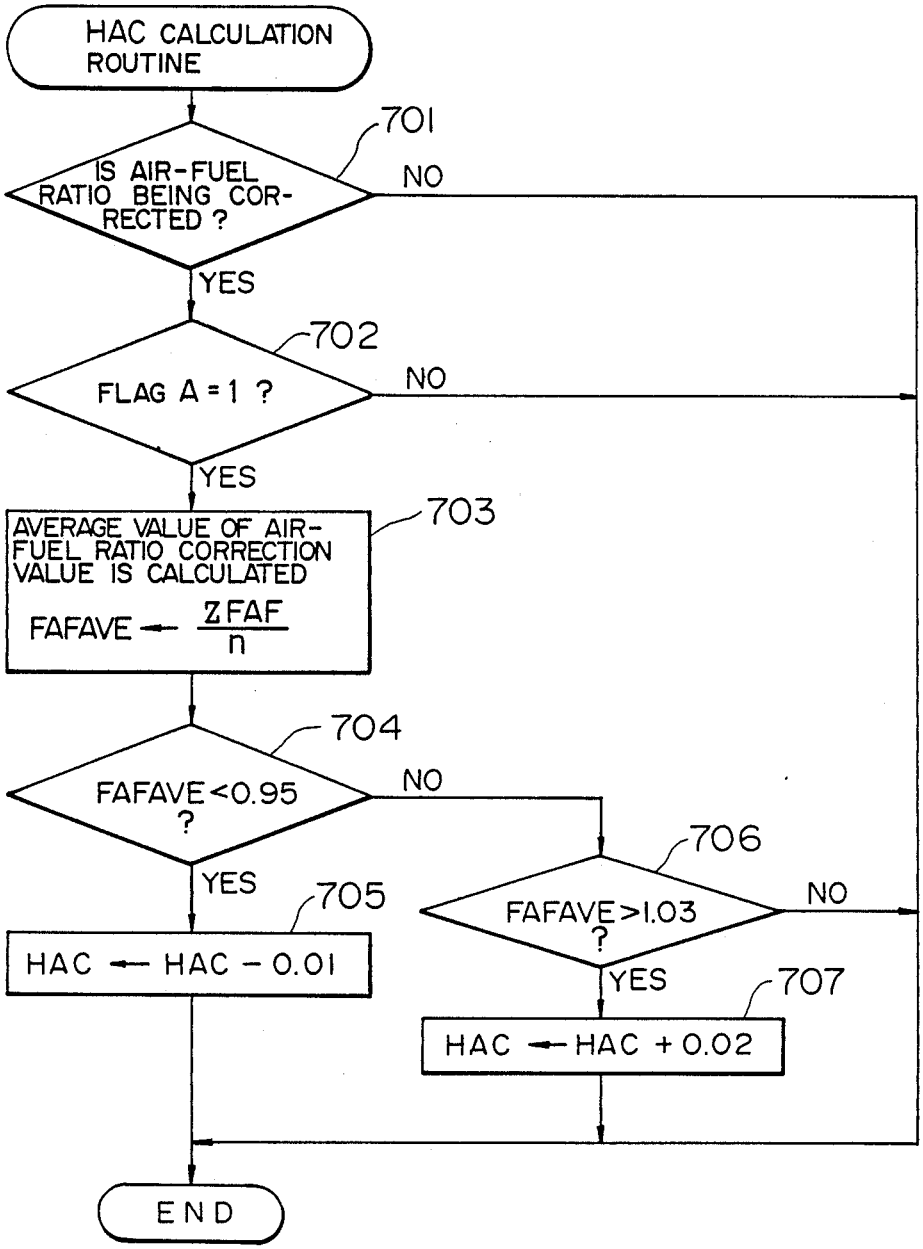

The process of calculating the above-mentioned correction coefficient HAC will now be described with reference to the flowchart shown in FIG. 7. First, in Step 701, a judgement is made as to whether or not an air-fuel ratio feedback (air-fuel ratio F/B), which is performed for the purpose of making the actual air-fuel ratio agree with the stoichiometrical air-fuel ratio in accordance with the output of the air-fuel ratio sensor 9, is being executed. If an air-fuel ratio F/B is being conducted, the procedure of Step 702 is executed. If not, this routine is terminated. In Step 702, it is judged whether or not a flag A is set up. In other words, a judgement is made as to whether the engine is being controlled by using the detected air intake quantity Gd depending on the signal from the air intake quantity sensor 5, or, instead, by using the estimated air intake quantity Gs. When the flag A is set up, i.e., when the estimated air intake quantity Gs is used for controlling the engine, the procedure proceeds to Step 703. When the flag A is not set up, i.e., when the detected air intake quantity Gd is used for controlling the engine, this routine is terminated. Obtained in Step 703 is an average value FAFAVE of the air-fuel ratio correction value FAF obtained through the air-fuel ratio F/B.

The process of obtaining the FAFAVE of the air-fuel ratio correction value FAF will now be described.

Figure 8:
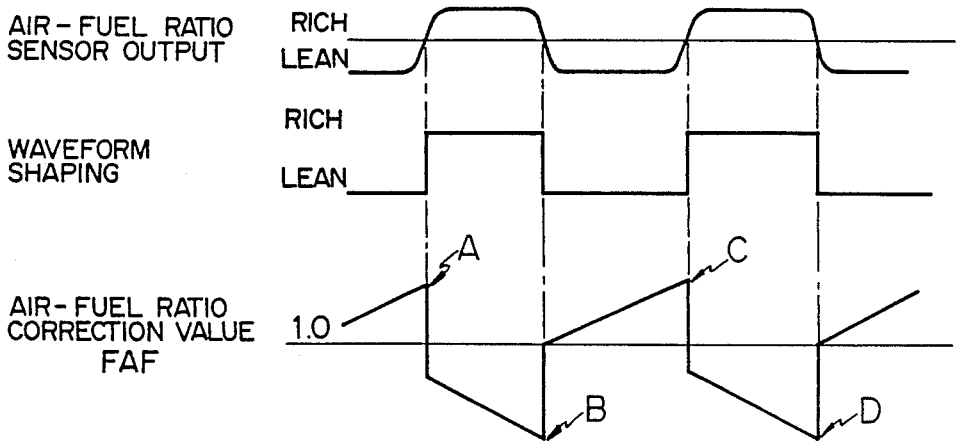
FIG. 8 is a time chart showing the relationship between the output of the air-fuel ratio sensor and the air-fuel ratio correction value FAF.

FIG. 8 shows the waveform of the output signal of the air-fuel ratio sensor 9, a signal obtained by shaping the waveform, and the variation in the air-fuel ratio correction coefficient FAF obtained on the basis of the signal. The air-fuel ratio correction value FAF is determined by integration, i.e., by reducing the value of the sensor output by a predetermined value $\Delta K$ while it indicates the rich condition and increasing it by the predetermined value $\Delta K$ while it indicates the lean condition, as well as by skipping, i.e., by increasing it by a predetermined value Ks when it has changed from the rich to the lean condition and reducing it by the predetermined value Ks when it has changed from the lean to the rich condition. In the process of calculating the fuel amount, the fuel amount is corrected by being multiplied by the correction value FAF during the air-fuel ratio F/B.

By the above-described process, a predetermined number (e.g., four) of correction values FAF, which changes in the manner shown in FIG. 8, immediately before skipping at the time of changing from the lean to the rich condition, are stored beforehand. In Step 703, the average value FAFAVE is calculated from the stored values (A, B, C, D).

The fact that the average value FAFAVE of the air-fuel ratio correction value FAF within the pulsation generating range during the air-fuel ratio F/B is obtained in order to obtain the correction coefficient HAC for correcting the estimated air intake quantity related to the intake air density is because of the following reason: If the air-fuel ratio based on the fuel amount determined from the estimated air intake quantity Gs and on the actual air intake quantity (weight) of the engine 1 agrees with the stoichiometrical air-fuel ratio, the average value FAFAVE is about 1.0. However, if there is any change in the density of the intake air, the estimated air intake quantity Gs does not agree with the actual air intake quantity, so that the average value FAFAVE varies from 1.0 by more than a predetermined value. On account of this, the change in the density of the intake air can be estimated from the condition of this average value FAFAVE, so that the calculated average value FAFAVE of the correction coefficient HAC can be utilized.

Referring again to FIG. 7, a judgment is made in Step 704 as to whether or not the average value FAFAVE of the air-fuel ratio correction value FAF is smaller than, for example, 0.95. If it is, the process proceeds to Step 705, where the current correction coefficient HAC is reduced by, for example, 0.01 to determine a new correction coefficient HAC, with which this routine is terminated. If, in Step 704, the average value FAFAVE is judged to be greater than 0.95, the process proceeds to Step 706. In Step 706, a judgment is made as to whether or not the average value FAFAVE is larger than, for example, 1.03. If it is, the process proceeds to Step 707, where the current correction coefficient HAC is increased by, for example, 0.02 to determine a new correction coefficient, with which this routine is terminated. If the average value is found to be less than 1.03, this routine is terminated.

The above-described routine for calculating the HAC is fundamentally so designed that the correction coefficient is gradually renewed when the vehicle moves from a lower to a higher altitude. The procedures of the above Steps 701 and 702 are to be executed under a load condition involving generation of intake air pulsation and during the air-fuel ratio F/B. Such conditions are set in correspondence with a movement to a higher altitude When the vehicle moves from a higher to a lower altitude, the throttle valve 6 is opened little, resulting in a condition in which the flag A is 0. Accordingly, it is impossible to renew the correction coefficient HAC through the HAC calculation routine, so that, if the vehicle returns in this condition to the lower altitude and the estimated air intake quantity Gs is used there, the fuel amount becomes rather small, resulting in a lean air-fuel ratio, since the HAC value remains the same as it was on the high altitude, i.e. the small value.

Figure 9:
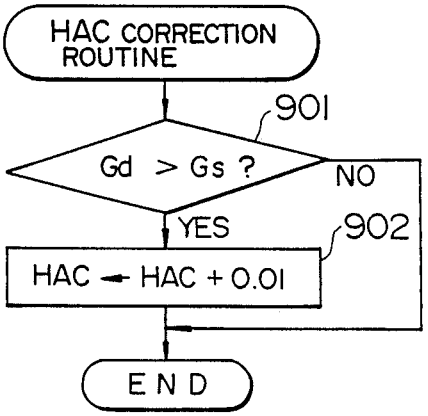

This problem is eliminated in this embodiment by correcting the correction coefficient HAC through the HAC correcting routine of Step 608 in FIG. 6. The process of HAC correcting routine will now be specifically described with reference to FIG. 9.

In this routine, the detected air intake quantity Gd and the estimated air intake quantity Gs obtained in Steps 601 and 603 are compared with each other in Step 901. If the detected air intake quantity Gd is larger than the estimated air intake quantity Gs, the correction coefficient HAC is corrected in Step 902 by being increased to terminate this routine. Otherwise, this routine is terminated without correcting the correction coefficient HAC.

Figure 10:
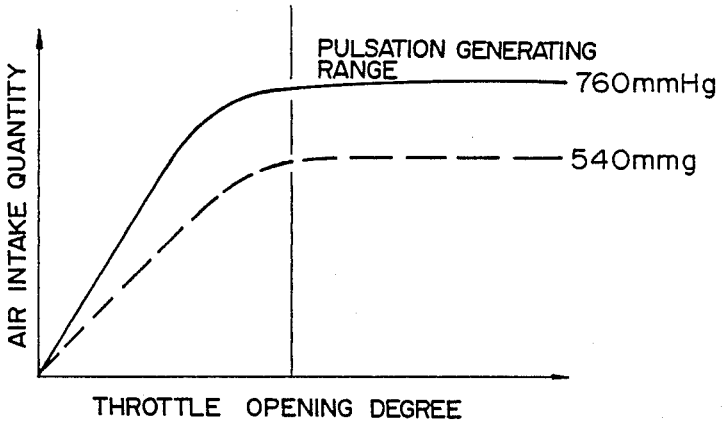
FIG. 10 is a graph showing the relationship between the air intake quantity and the throttle opening degree.
Figure 11:
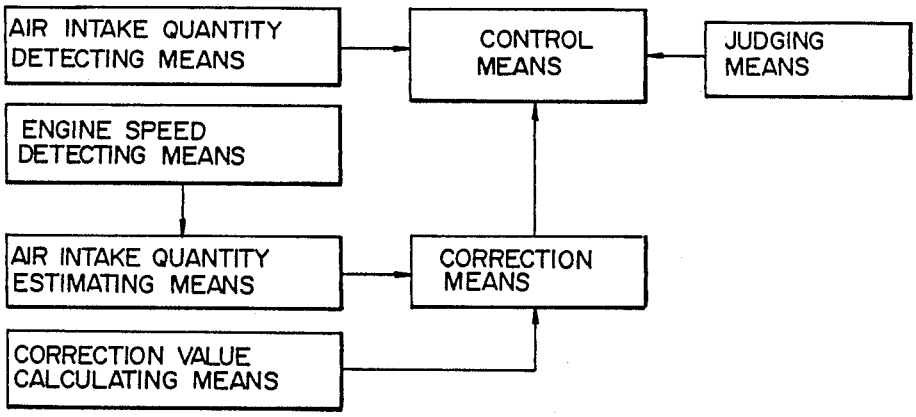
FIG. 11 is a block diagram schematically illustrating the construction of the device of this invention.

In the above processing, a condition: Gd>Gs cannot usually take place because the throttle valve 6 is almost fully open when the engine 1 is running within the pulsation generating range, so that the air intake quantity is inevitably larger than when it is running outside this range. The condition Gd>Gs occurs only when the vehicle moves from a higher to a lower altitude and the actual air intake quantity has changed from a value indicated by the broken line in FIG. 10 to that indicated by the solid line in FIG. 10 but the estimated air intake quantity remains that indicated by the dashed line in FIG. 10. This condition tells that the vehicle has returned from the higher to the lower altitude, so that the correction coefficient HAC can be corrected by increasing it, as in Step 902. This processing makes it possible to correct the correction coefficient HAC to a value for the richer air-fuel ratio even in a down-hill condition in which the procedure of Step 703 and those of the steps thereafter for calculating the HAC cannot be performed.

Thus, by the above described procedures, the correction coefficient HAC for the estimated air intake quantity related to the intake air density can be obtained by using the air-fuel ratio correction value.

In the central processing unit in the ECU 10, a reference injection time length Tp is determined on the basis of the air intake quantity stored in the address G of the RAM and the engine speed and is corrected in accordance with the intake air temperature, the water temperature, the throttle opening degree, etc. If the air-fuel ratio F/B is being executed, it is further corrected by the air-fuel ratio correction value FAF to obtain an effective injection time length $T_1$, to which is added an invalid injection time length Tv which depends upon the battery voltage, thereby determining an output injection time length TAU. The injection values 8 are operated at the rotational period, in response to a drive pulse in accordance with this time length TAU.

The injection timing is also controlled on the basis of the air intake quantity stored in the address g of the RAM, the engine speed, the water temperature, etc.

Thus, in the above-described embodiment, the engine control (fuel injection control and ignition timing control) is executed by using, instead of the detected air intake quantity, the estimated air intake quantity estimated on the basis of the engine speed and corrected by the correction coefficient HAC corresponding to the intake air density even if a number of errors are contained in the value of the air intake quantity detected based upon the output from the air intake sensor when the engine 1 is operated within the intake air pulsation generating range. Thus, the air-fuel ratio can be kept at an appropriate value, irrespective of whether or not intake air pulsations take place, and without being affected by changes in the intake air density. Furthermore, the engine control operations including the fuel injection control and the injection timing control can be executed in an appropriate manner.

In addition, since in this embodiment the correction coefficient HAC for correcting the estimated air intake quantity is obtained by reference to the air-fuel ratio correction value during the air-fuel ratio F/B, the density compensation for the estimated air intake quantity can be conducted solely by a simple calculation process, without using a sensor separately provided for measuring the intake air density.

While the above-described embodiment is so designed that the density compensation for the estimated air intake quantity can be performed without using a sensor separately provided for intake air density compensation for that purpose, an appropriate engine control can also be realized by separately providing an atmospheric pressure sensor in order to obtain the intake air density on the basis of the output of this sensor and that of an intake air pressure sensor for the purpose of correcting the estimated air intake quantity by reference to the intake air density thus obtained.

Figure 12:
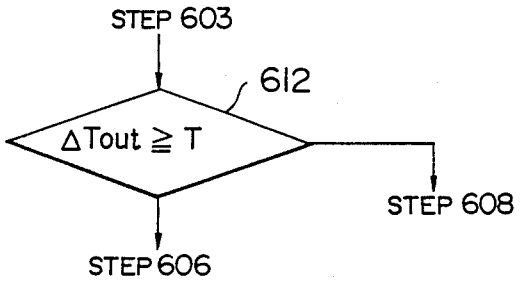
FIG. 12 illustrates in flowchart a modification to the processing shown by the flowchart in FIG. 6.

Furthermore, while in the above-described embodiment the judgement as to whether or not the engine 1 is operated within the intake air pulsation generating range is made based on the throttle opening degree and the engine speed, the judgement can also be made on the basis of the output form the air intake sensor 5. Specifically, the judgement as to whether or not the engine 1 is running within the intake air pulsation generating range can be made on the basis of the fact that the difference between the respective time lengths $T_{out}$ (i) and $T_{out}$ (i+1) of the two output signals obtained during one ignition cycle is greater than a predetermined value in the intake air pulsation generating range. Namely, instead of performing the procedures of Steps 604 and 605 of FIG. 6, a judgement is made in Step 612, as shown in FIG. 12, as to whether or not the difference $\Delta T_{out}$ between the respective time lengths of the two output signals obtained during one ignition cycle is greater than a predetermined value T. If it is greater than the predetermined value, the process proceeds to Step 606. If not, the process proceeds to Step 608. In this regard, it is desirable that this predetermined value T be set in correspondence with the engine speed, taking into account the reverse flow components in the heavy load range. Namely, it should be so set as to be larger at a lower engine speed range and smaller at a higher one.

Thus, this invention is so designed that the estimated air intake quantity obtained on the basis of the engine speed is used, instead of the detected air intake quantity, for controlling the engine when the engine is running within the intake air pulsation generating range and that the estimated air intake quantity is corrected by reference to a correction value which is obtained in relation to the intake air density. Accordingly, even if the estimated air intake quantity is used when the vehicle on which the engine is mounted is moving between a higher and a lower altitude, the air-fuel ratio can be prevented from being excessively rich or lean, thereby making it possible to control the engine in an appropriate manner, irrespective of changes in the intake air density.

What is claimed is:

1. A control device for an internal combustion engine, comprising:

air intake quantity detecting means for detecting a quantity of air input into the internal combustion engine;

engine speed detecting means for detecting a rotational speed of the internal combustion engine;

judging means for judging whether or not the engine is running in an intake air pulsation generating range based on operational parameters of the engine;

air intake quantity estimating means for estimating a quantity of air input into the internal combustion engine based on the engine speed detected by said engine speed detecting means;

correction value calculating means for calculating a correction value related to the density of the air input into the internal combustion engine;

correction means for correcting, by the correction value obtained by means of said correction value calculating means, the air intake quantity estimated by said air intake quantity estimating means;

control means adapted to control the engine in accordance with the estimated air intake quantity as corrected by said correction means when the engine is judged to be running in the intake air pulsation generating range, and in accordance with the air intake quantity detected by said air intake quantity detecting means when the engine is judged to be running outside the intake air pulsation generating range; and air-fuel ratio detecting means for detecting the air-fuel ratio of the air-fuel mixture supplied to the engine, wherein said control means includes:

reference fuel amount calculating means for calculating a reference amount of fuel supplied to the engine in accordance with one of said detected air intake quantity and said estimated air intake quantity as corrected;

fuel amount correcting means for correcting the calculated reference fuel amount by an air-fuel ratio correction value which is determined in accordance with the result of comparison between the air-fuel ratio detected by means of said air-fuel ratio detecting means and a predetermined air-fuel ratio; and fuel supply means for supplying the corrected amount of fuel to the engine;

the air-fuel ratio of the air-fuel mixture applied to the engine being so controlled that it agrees with said predetermined air-fuel ratio.

2. A control device for an internal combustion engine as claimed in claim 1, wherein said correction value calculating means calculates the correction value for correcting the estimated air intake quantity in accordance with the air-fuel ratio correction value in said fuel amount correcting means.

3. A control device for an internal combustion engine as claimed in claim 1, wherein said correction value calculating means execute the calculation of the correction value which is based upon said air-fuel ratio correction value when the engine is judged by said judging means to be running in the intake air pulsation generating range.

4. A control device for an internal combustion engine, comprising:

air intake quantity detecting means for detecting a quantity of air input into the internal combustion engine;

engine speed detecting means for detecting a rotational speed of the internal combustion engine;

judging means for judging whether or not the engine is running in an intake air pulsation generating range based on operational parameters of the engine;

air intake quantity estimating means for estimating a quantity of air input into the internal combustion engine based on the engine speed detected by said engine speed detecting means;

correction value calculating means for calculating a correction value related to the density of the air input into the internal combustion engine;

correction means for correcting, by the correction value obtained by means of said correction value calculating means, the air intake quantity estimated by said air intake quantity estimating means; and control means adapted to control the engine in accordance with the estimated air intake quantity as corrected by said correction means when the engine is judged to be running in the intake air pulsation generating range, and in accordance with the air intake quantity detected by said air intake quantity detecting means when the engine is judged to be running outside the intake air pulsation generating range;

wherein said correction value calculating means compares said corrected estimated air intake quantity with said detected air intake quantity when the engine is judged by said judging means to be running outside the intake air pulsation generating range, for thereby correcting, when said detected air intake quantity is judged to be greater, the correction value for correcting said estimated air intake quantity in such a manner that said estimated air intake quantity is increased.

5. A control device for an internal combustion engine as claimed in claim 1, wherein said air intake quantity detecting means detect the weight of the air sucked into the internal combustion engine.

6. A control device for an internal combustion engine as claimed in claim 5, wherein said air intake quantity detecting means comprises an air flow meter of the heat wire type.

7. A control device for an internal combustion engine as claimed in claim 6, wherein said air flow meter includes:

a bridge circuit connected to a power source and including a first temperature dependant resistor disposed in an intake air passage of the engine and adapted to generate heat when supplied with electricity, a second temperature dependant resistor disposed in the intake air passage and adapted to detect the temperature of the air flowing through this intake air passage, and at least two fixed resistors;

comparing means for comparing a first electric potential at a point between said first temperature dependant resistor and one of said fixed resistors of said bridge circuit with a second electric potential at a point between said second temperature dependant resistor and the other fixed resistor of said bridge circuit; and signal output means for outputting a signal corresponding to the result of comparison executed by said comparing means.

8. A control device for an internal combustion engine as claimed in claim 1, wherein said judging means makes a judgment based on an engine speed as to whether or not the engine is running in the intake air pulsation generating range.

9. A control device for an internal combustion engine as claimed in claim 1, wherein said judging means makes a judgment based on a throttle opening degree of the engine as to whether or not the engine is running in the intake air pulsation generating range.

10. A control device for an internal combustion engine as claimed in claim 1, wherein said judging means makes a judgment based on a magnitude of fluctuation of a detected air intake quantity during one ignition cycle as to whether or not the engine is running in the intake air pulsation generating range.

11. A control device for an internal combustion engine according to claim 4, wherein said air intake quantity detecting means detects a weight of the air sucked into the internal combustion engine.

12. A control device for an internal combustion engine according to claim 11, wherein said air intake quantity detecting means comprises an air flow meter of the heat wire type.

13. A control device for an internal combustion engine, comprising:

air intake quantity detecting means for detecting a quantity of air input into the internal combustion engine;

engine speed detecting means for detecting a rotational speed of the internal combustion engine;

judging means for judging whether or not the engine is running in an intake air pulsation generating range based on operational parameters of the engine;

air intake quantity estimating means for estimating a quantity of air input into the internal combustion engine based on the engine speed detected by said engine speed detecting means;

correction value calculating means for calculating a correction value related to a density of the air sucked into the internal combustion engine;

correction means for correcting, by the correction value obtained by means of said correction value calculating means, the air intake quantity estimated by means of said air intake quantity estimating means; and control means adapted to control the engine in accordance with the estimated air intake quantity as corrected by said correction means when the engine is judged to be running in the intake air pulsation generating range, and in accordance with the air intake quantity detected by said air intake quantity detecting means when the engine is judged to be running outside the intake air pulsation range, wherein said air intake quantity detecting means detects a weight of the air input into the internal combustion engine, and wherein said air intake quantity detecting means comprises an air flow meter of the heat wire type.

14. A control device for an internal combustion engine according to claim 12, wherein said air flow meter includes:

a bridge circuit connected to a power source and including a first temperature dependent resistor disposed in an intake air passage of the engine and adapted to generate heat when supplied with electricity, a second temperature dependent resistor disposed in the intake air passage and adapted to detect the temperature of the air flowing through this intake air passage, and at least two fixed resistors;

comparing means for comparing a first electric potential at a point between said first temperature dependent resistor and one of said fixed resistors of said bridge circuit with a second electric potential at a point between said second temperature dependent resistor and the other fixed resistor of said bridge circuit; and signal output means for outputting a signal corresponding to the result of comparison executed by said comparing means.

15. A control device for an internal combustion engine according to claim 13, wherein said air flow meter includes:

a bridge circuit connected to a power source and including a first temperature dependent resistor disposed in an intake air passage of the engine and adapted to generate heat when supplied with electricity, a second temperature dependent resistor disposed in the intake air passage and adapted to detect the temperature of the air flowing through this intake air passage, and at least two fixed resistors;

comparing means for comparing a first electric potential at a point between said first temperature dependent resistor and one of said fixed resistors of said bridge circuit with a second electric potential at a point between said second temperature dependent resistor and the other fixed resistor of said bridge circuit; and signal output means for outputting a signal corresponding to the result of comparison executed by said comparing means.

16. A control device for an internal combustion engine according to claim 4, wherein said judging means makes a judgment based on an engine speed as to whether or not the engine is running in the intake air pulsation generating range.

17. A control device for an internal combustion engine according to claim 13, wherein said judging means makes a judgment based on an engine speed as to whether or not the engine is running in the intake air pulsation generating range.

18. A control device for an internal combustion engine according to claim 4, wherein said judging means makes a judgment based on a throttle opening degree of the engine as to whether or not the engine is running in the intake air pulsation generating range.

19. A control device for an internal combustion engine according to claim 4, wherein said judging means makes a judgment based on a magnitude of fluctuation of a detected air intake quantity during one ignition cycle as to whether or not the engine is running in the intake air pulsation generating range.

* * * * *